US008393684B2

(12) United States Patent
Peraza

(10) Patent No.: US 8,393,684 B2
(45) Date of Patent: Mar. 12, 2013

(54) MOBILITY DEVICES AND METHODS

(75) Inventor: Alfred H. Peraza, Prescott Valley, AZ (US)

(73) Assignee: Safe Patient Solutions, LLC, Prescott Valley, AZ (US)

( * ) Notice: Subject to any disclaimer, the term of this patent is extended or adjusted under 35 U.S.C. 154(b) by 756 days.

(21) Appl. No.: 12/573,778

(22) Filed: Oct. 5, 2009

(65) Prior Publication Data

US 2011/0079466 A1 Apr. 7, 2011

(51) Int. Cl.

| | |
|---|---|
| ***A61G 7/10*** | (2006.01) |
| ***A47C 16/00*** | (2006.01) |
| ***E06C 1/38*** | (2006.01) |

(52) U.S. Cl. ..... 297/423.4; 297/423.11; 297/423.44; 297/DIG. 10; 5/81.1 R; 182/33

(58) Field of Classification Search ..... 297/423.39, 297/423.4, 423.41; 5/81.1 R; 182/33, 35
See application file for complete search history.

(56) References Cited

U.S. PATENT DOCUMENTS

| | | | | |
|---|---|---|---|---|
| 3,142,355 | A * | 7/1964 | Danielson | 182/106 |
| 5,381,873 | A * | 1/1995 | Kniefel et al. | 182/152 |
| 5,692,445 | A * | 12/1997 | Winer | 108/100 |
| 6,571,915 | B1 * | 6/2003 | de la Tour | 182/152 |
| 6,719,094 | B2 * | 4/2004 | de la Tour | 182/152 |
| 7,814,708 | B2 * | 10/2010 | Rivera et al. | 52/10 |
| 2008/0029342 | A1 * | 2/2008 | Genova | 182/151 |

OTHER PUBLICATIONS www.paraladder.com.

* cited by examiner

*Primary Examiner* — David Dunn
*Assistant Examiner* — Timothy J Brindley
(74) *Attorney, Agent, or Firm* — RHR Firm PLLC; Jason C Beckstead; John Burr

(57) ABSTRACT

A mobility device including multiple levels at different heights, beginning with a first level at substantially 4 to 6 inches from a floor surface, and with every subsequent level substantially 4 to 6 inches above the last level, and including a surface on the levels for a user to pull themselves onto, one level at a time, until the user is at a height by which they may either sit on a chair or regain their footing.

20 Claims, 13 Drawing Sheets

$d_1$ =Vertical distance between 101 and 102

$d_2$ =Vertical distance between 101 and 108

MOBILITY DEVICES AND METHODS

FIELD

The subject technology generally relates to personal dignity and therapy devices and methods, and specifically relates to physical therapy and/or training devices and methods for enabling a fallen person to regain a sitting or standing position using an up-from-floor-device ("UFFD").

BACKGROUND

Injured, frail, or elderly persons often find themselves at the mercy of other people for providing their care, and particularly so when they have fallen to the ground and cannot get back up, whether to a sitting position or to their feet. Such situations not only potentially take away personal dignity, but may also pose a risk to those coming to the aid of the fallen person, and may lead to caregiver back, knee, or similar injuries. Moreover, in an attempt to help those that have fallen down, caregivers can inadvertently hurt those they are trying to help, for instance when a wheelchair rolls away unexpectedly or when a caregiver suffers an injury of their own (i.e., as when a back or knee gives out) causing them to drop the person they are intending to help.

SUMMARY

The subject technology overcomes the previous problems by providing injured, frail, or elderly persons with the ability to raise themselves to a sitting and/or standing position with or without the help of a caregiver. The subject technology also provides a training system by which people may undergo therapy to relearn or to learn better how to reach a sitting or standing position from the floor. Herein, the subject technology is generally termed an "Up From Floor Device," or UFFD, and individual embodiments of a UFFD may include all of the elements of the claims and written description as provided herein, or a portion or portions of the element(s) of the claims and written description as provided herein.

In accordance with the subject technology, an UFFD is provided with multiple levels at different heights, each within substantially 4 to 6 inches of vertical distance of each other, and with each level being substantially 26 to 30 inches in length and 10 to 12 inches in depth. Each level is substantially parallel to a reference plane established by a floor surface, and may be configured to tilt in a controlled fashion to within 30 degrees of the reference plane. In addition to a device, the subject technology also includes a method whereby a user utilizes a handle or grip at each level for pulling their persons onto each level, one level at a time, until they have reached a height whereby they may then reach a sitting or standing position.

Additional features and advantages of the subject technology will be set forth in the description below, and in part will be apparent from the description, or may be learned by practice of the subject technology. The advantages of the subject technology will be realized and attained by the structure particularly pointed out in the written description and claims hereof, as well as the appended drawings.

It is to be understood that both the foregoing general description and the following detailed description are exemplary and explanatory and are intended to provide further explanation of the subject technology as claimed.

BRIEF DESCRIPTION OF THE DRAWINGS

The accompanying drawings, which are included to provide further understanding of the subject technology and are incorporated in and constitute a part of this specification, illustrate aspects of the subject technology and together with the description serve to explain the principles of the subject technology. The features and nature of the present disclosure will become more apparent from the detailed description set forth below when taken in conjunction with the drawings in which like reference characters identify correspondingly throughout and wherein.

DETAILED DESCRIPTION

In the following detailed description, numerous specific details are set forth to provide a full understanding of the subject technology. It will be obvious, however, to one ordinarily skilled in the art that the subject technology may be practiced without some of these specific details. In other instances, well-known structures and techniques have not been shown in detail so as not to obscure the subject technology.

Figure 1:
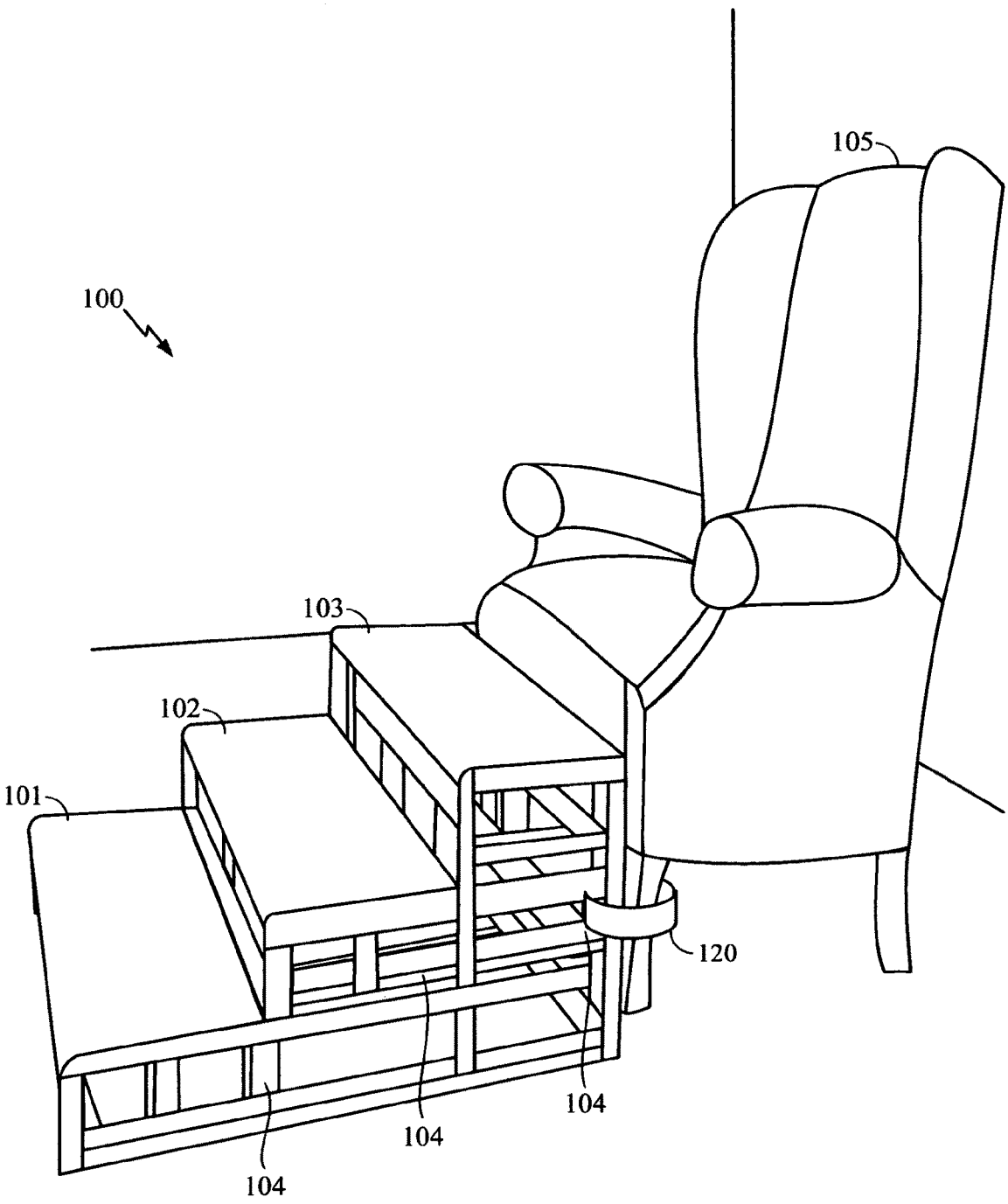
FIG. 1 is a side view of an exemplary UFFD 100.

FIG. 1 a side view of an exemplary UFFD 100. As shown in the Figure, the UFFD comprises a first level 101, a second level 102, and third level 103, a support structure 104, a chair 105, and an attachment connection 120. In various embodiments of the subject technology, the chair 105 may be a wheelchair, a bench, a waiting room chair, or any other seating device. Furthermore, some embodiments of the subject technology may be practiced and utilized without a chair 105. Although shown as including three levels 101, 102, and 103, UFFD 100 may include as few as one or two levels, or multiples of levels in excess of three.

All of first level 101, second level 102, and third level 103 are substantially 26 to 30 inches in length, and 10 to 12 inches in width/depth. One of ordinary skill in the art recognizes that the terms "length, width, and depth" and similar descriptors provide a frame of reference from a particular point of view, and that from a different point of view, different terms might be used. That is, "length," "width," and "depth" are all a matter of perception. For instance, "depth" can be used to describe "width," with the term changing merely upon a point of reference. Given this, these terms are meant to be used interchangeably, as would be understood by one of ordinary skill in the art.

Figure 5:
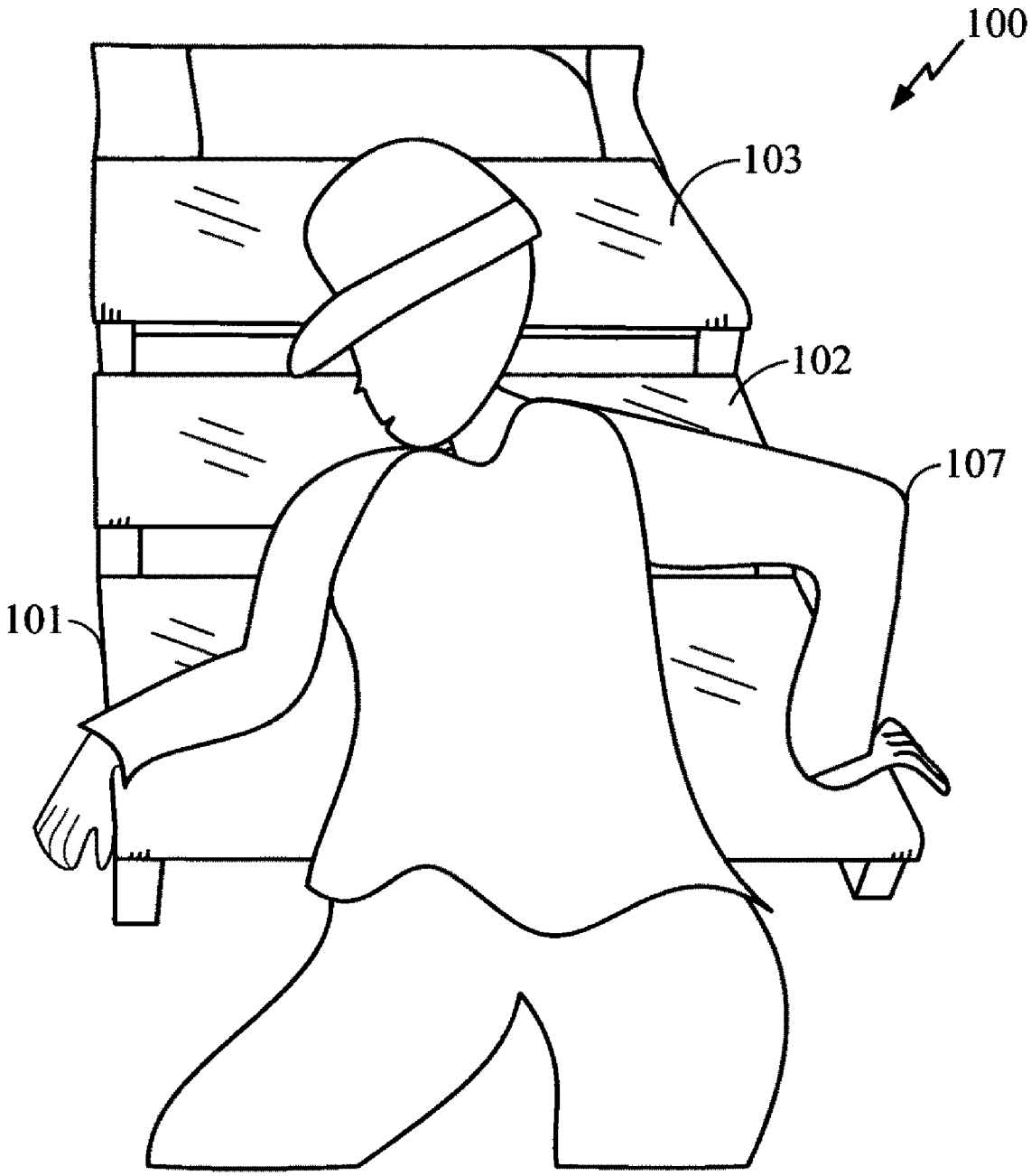
FIG. 5 is an illustration of a manner or method of use of an exemplary UFFD 100.

First level 101, second level 102, and third level 103 may be of various lengths and widths based upon implementation. For instance, an UFFD for a small child or adult would require less surface area, whereas an UFFD for a large adult would require more surface area. In some embodiments, a top surface of at least one of levels 101, 102, and/or 103 may be covered with a non-slip surface and/or may include padding for a user's extremities for comfort during use. Pressure relief pads (such as shown as element 113 in FIG. 12) may be configured across lateral horizontal surfaces of the first level 101, the second level 102, and/or the third level 103. Pressure relief pads may be utilized as an alternative and/or in addition to hand grips when a patient in unable to bear weight through their hands (such as in the case of osteoarthritis, rheumatoid arthritis, a healing wrist fracture, or hand/wrist pathology). In such instances, patients/users may need to push themselves up using their elbows and/or forearms, such as shown in FIG. 5 with the user's right elbow.

Levels 101, 102, and 103, and support structure 104 may be a carbon composite, foam, metal, wood, plastic, or fiberglass, or any combination of these or other structural materials. In certain embodiments, support structure 104 may be configured to support up to 400 pounds in weight as spread across a surface area of the individual levels 101, 102, and/or 103.

As shown in FIG. 1, the support structure 104 in an exemplary embodiment may comprise a wooden structure with cross members, rails, and standing posts, as necessary, to support levels 101, 102, and/or 103 for the expected weight of a use. For instance, for a small child support structure 104 may support a weight of up to 100 pounds, while as for a large adult support structure 104 may support a weight of up to 400 pounds. Also as shown in FIG. 1, the leading edge of each of levels 101, 102, and 103 is curved to less than 90 degrees, thereby causing far less shear force against a user's body as they manipulate themselves up each level 101, 102, and 103. UFFD 100 also includes attachment connection 120. Attachment connection 120 may be a band or loop of metal or other material such as Velcro, or leather straps with a buckle that connects chair 105 to the UFFD 100, preventing chair 105 from movement during use of the UFFD 100. Attachment connection 120 may alternatively be a male and female connector that locks in place when connection is desired, or another form of connection.

Figure 2:
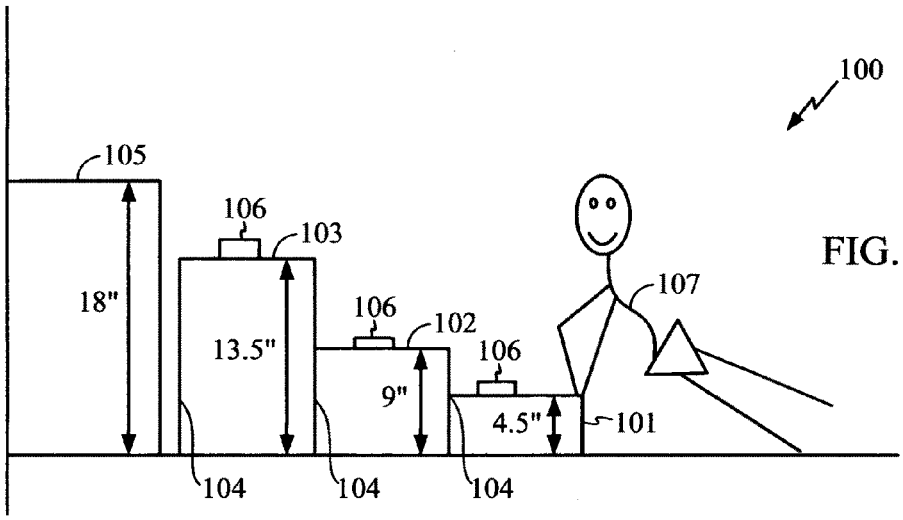
FIG. 2 is a schematic side view of an exemplary UFFD 100.

FIG. 2 is a side view of an exemplary UFFD 100, wherein example vertical dimensions are shown. As depicted, a user 107 may have fallen and may be in need of getting up from the floor. User 107 makes his way to the first level 101 that is approximately 4.5 inches in vertical height from floor surface 108. Level 101 is supported by support structure 104. User 107 pulls their person adjacent to level 101, and then by utilizing handle or grip 106, user 107 is able to pull their person onto level 101.

Once upon level 101, user 107 is able pull their person onto level 102. Level 102 is substantially a mere 4.5 inches difference in height from level 101, and is a total of substantially 9 inches from the floor surface 108. Utilizing handle or grip 106, user 107 is able to pull their person onto level 102.

Once upon level 102, user 107 is able to pull their person onto level 103. Level 103 is substantially a mere 4.5 inches difference in height from level 102, and is a total of substantially 13.5 inches from the floor surface 108. Utilizing handle or grip 106, user 107 is able to pull their person onto level 103.

Once upon level 103, user 107 is able to pull their person onto chair 105. Chair 105 may be any vertical distance from floor surface 108, but preferably is approximately 15 or more inches in vertical distance from floor surface 108. Chair 105 may be permanently or detachably connected to support structure 104 adjacent to third level 103. A permanent attachment might include a weld, a bolt, or similar configuration, and a detachable connection may also include a bolt or a quick turn release with male and female members, as one of skill in the art would comprehend. As noted above, chair 105 may be a wheelchair or other chair. As shown in FIG. 2, chair 105 may be 18 inches in distance from floor surface 108, but also as noted above, the vertical distance may be essentially anything 15 inches or greater, depending upon implementation and the height of an expected user. This same rule applies to vertical height of individual levels (101, 102, and/or 103) in relation to an expected user's size. That is, people of different sizes may utilize differently sized UFFDs based upon individual characteristics.

Figure 3:
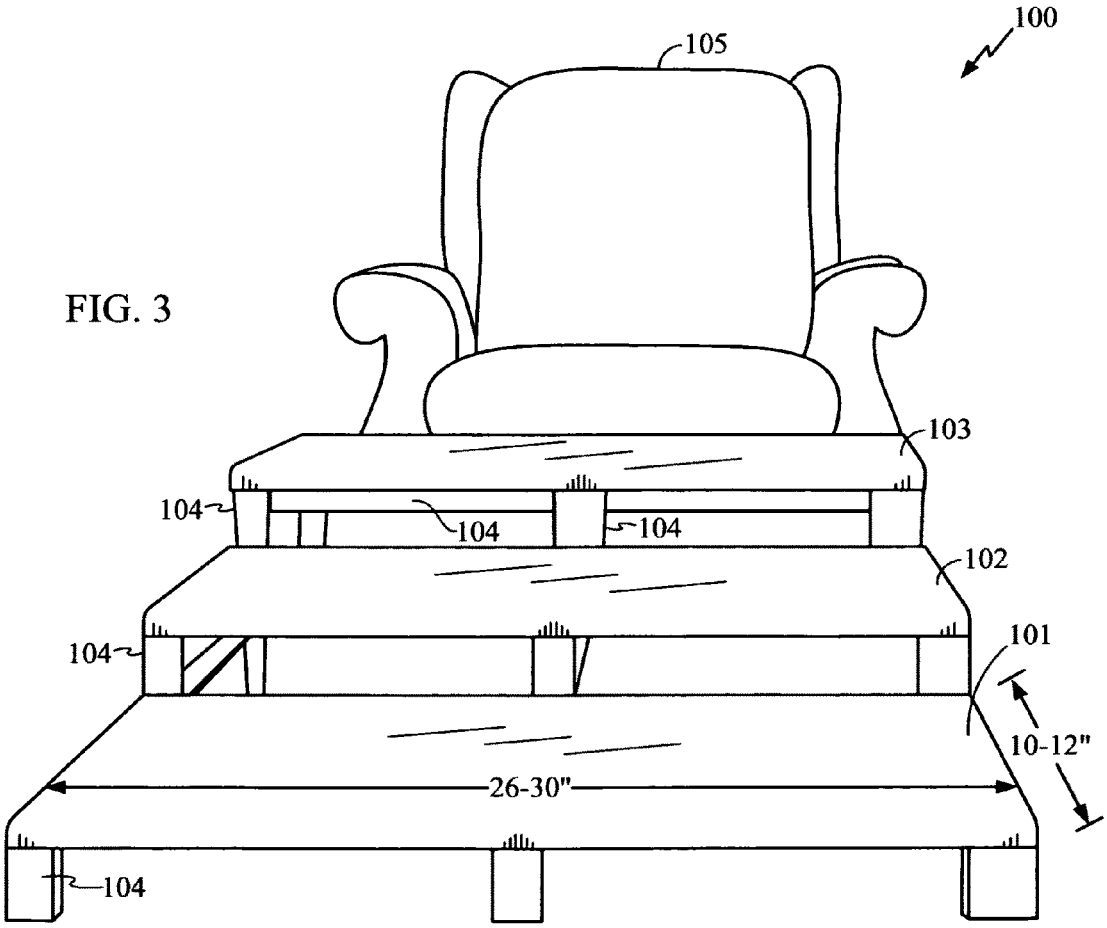
FIG. 3 is a front view of an exemplary UFFD 100.

FIG. 3 is a front view of an example UFFD. As shown in FIG. 3, UFFD 100 comprises a first level 101, a second level 102, a third level 103, a support structure 104, and a chair 105. First level 101 is substantially 26-30 inches in length and is 10-12 inches in width/depth. Chair 105 is simply adjacent and higher than third level 103, and in the example shown is kept in place by one of the above-described connection attachment devices.

Figure 4:
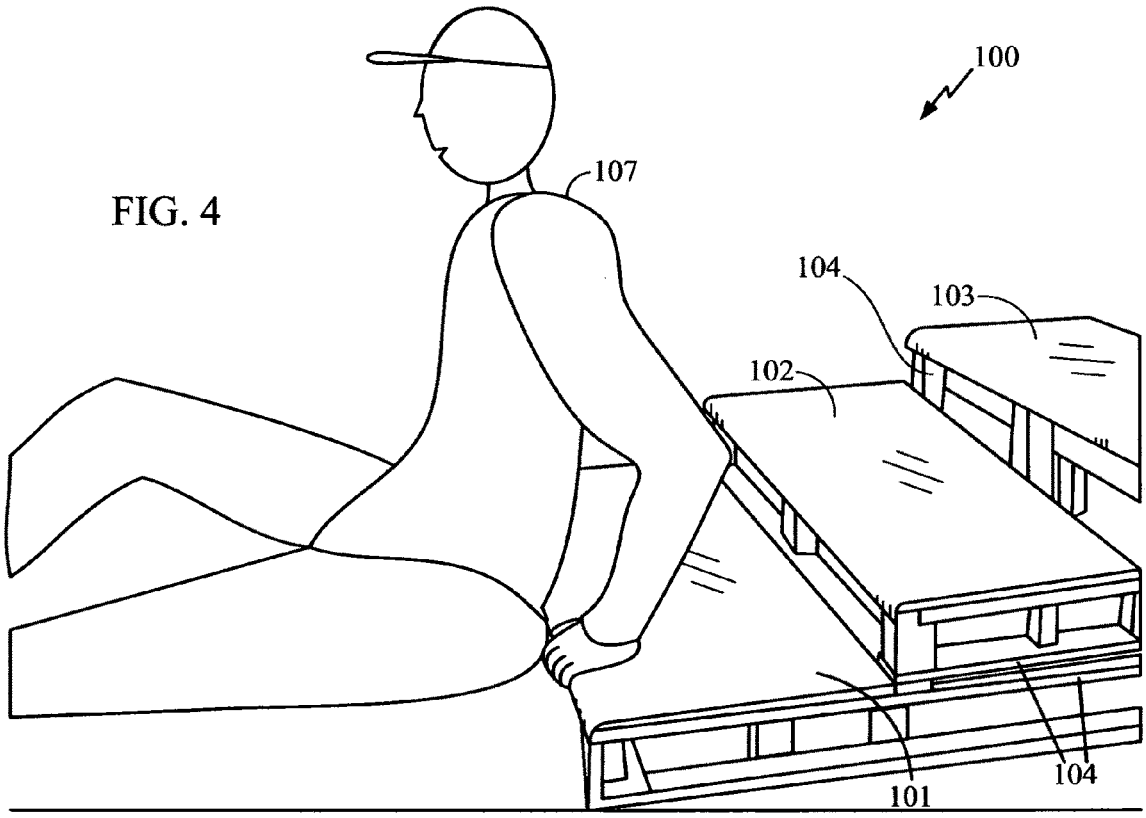
FIG. 4 is an illustration showing a manner or method of use of an exemplary UFFD 100.

FIG. 4 is a side view of a manner/method of use for an example UFFD. As shown in FIG. 4, a user 107 is starting from the floor surface and has grasped a hand grip comprising the front edge of level 101 that is substantially 4.5 inches above the floor surface. User 107 is utilizing arm muscles to move her person up and onto level 101. Also shown in FIG. 4 are levels 102 and 103, and support structure 104. A patient/user may utilize one or more lower extremities (such as legs) in conjunction with the upper extremities (such as hands and elbows) and arm muscles to assist themselves up to chair level using the UFFD 100.

FIG. 5 is a front view of a manner/method of use for an example UFFD. A shown in FIG. 5, a user 107 uses a left arm to brace and pivot from a hand hold on a grip or handle of the first level 101, while using a right forearm to position herself for mounting her body onto first level 101. Also shown in FIG. 5 are levels 102 and 103.

Figure 6:
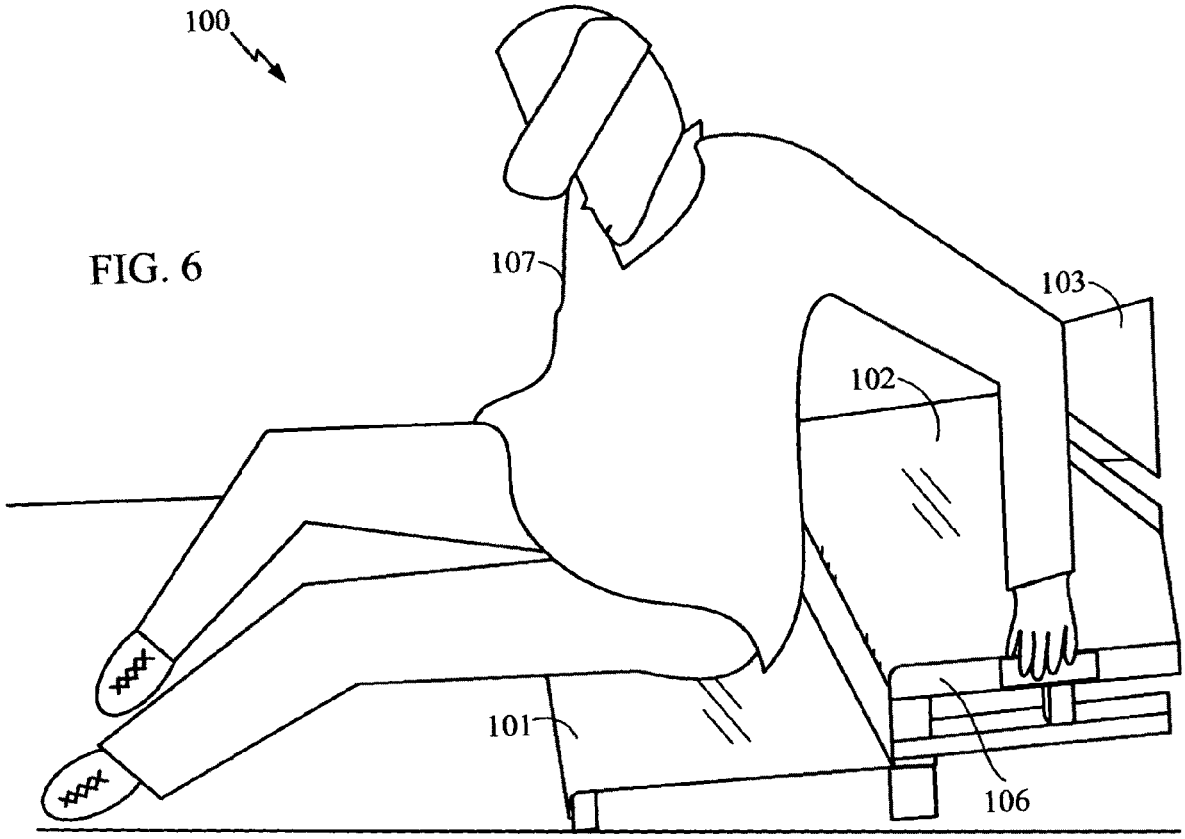
FIG. 6 is an illustration of a manner or method of use of an exemplary UFFD 100.

FIG. 6 is a side view of a manner/method of use for an example UFFD. As shown in FIG. 6, a user 107 has made her way onto level 101 and is now proceeding to grasp a handle/hand grip 106 on level 102 so that she may maneuver and pull her body up onto level 102. Also shown in FIG. 6 is level 103.

Figure 7:
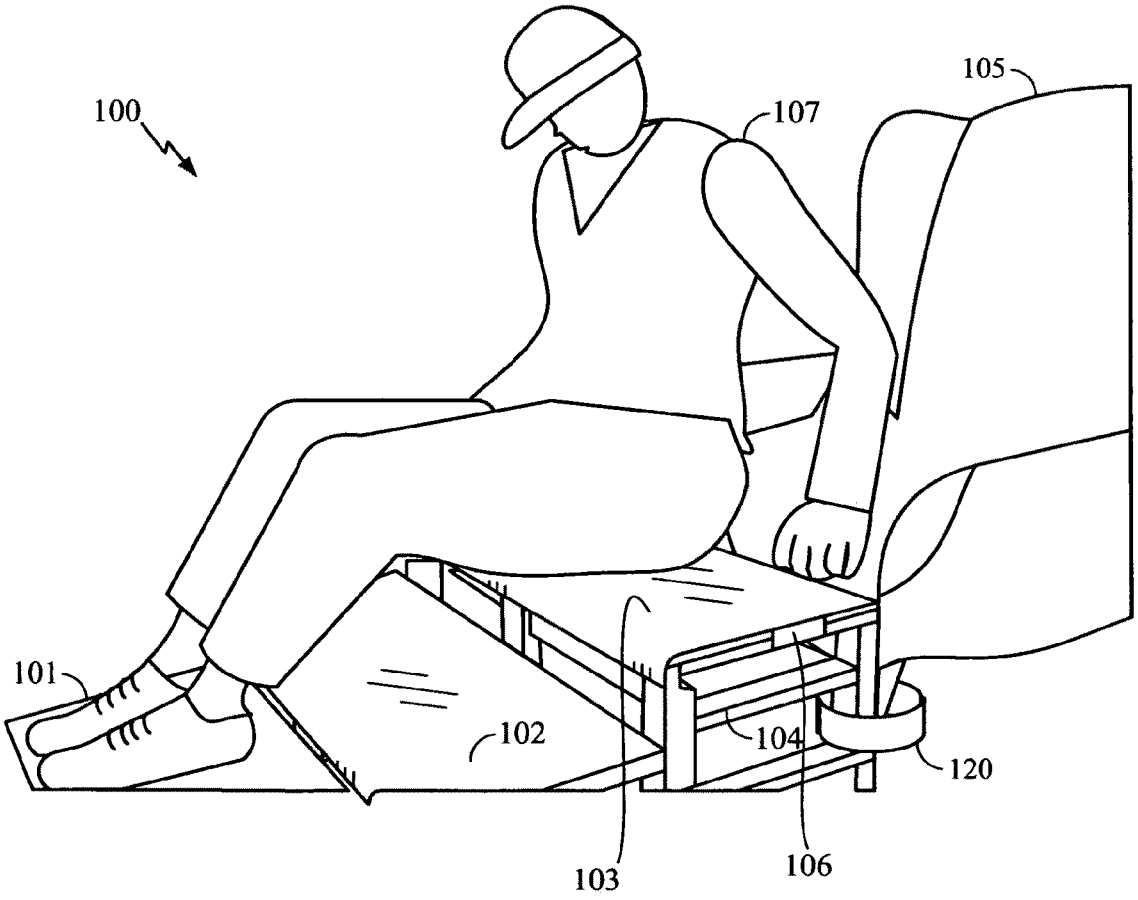
FIG. 7 is an illustration of a manner or method of use of an exemplary UFFD 100.

FIG. 7 is a side view of a manner/method of use for an example UFFD. As shown in FIG. 7, a user 107 has made her way onto level 103 (by having grasped a handle or hand grip 106 and by pulling her body onto level 103) and is now utilizing both of her arms and feet to maneuver her body into position so that she may mount chair 105. Also shown in FIG. 7 are support structure 104 and level 102.

Figure 8:
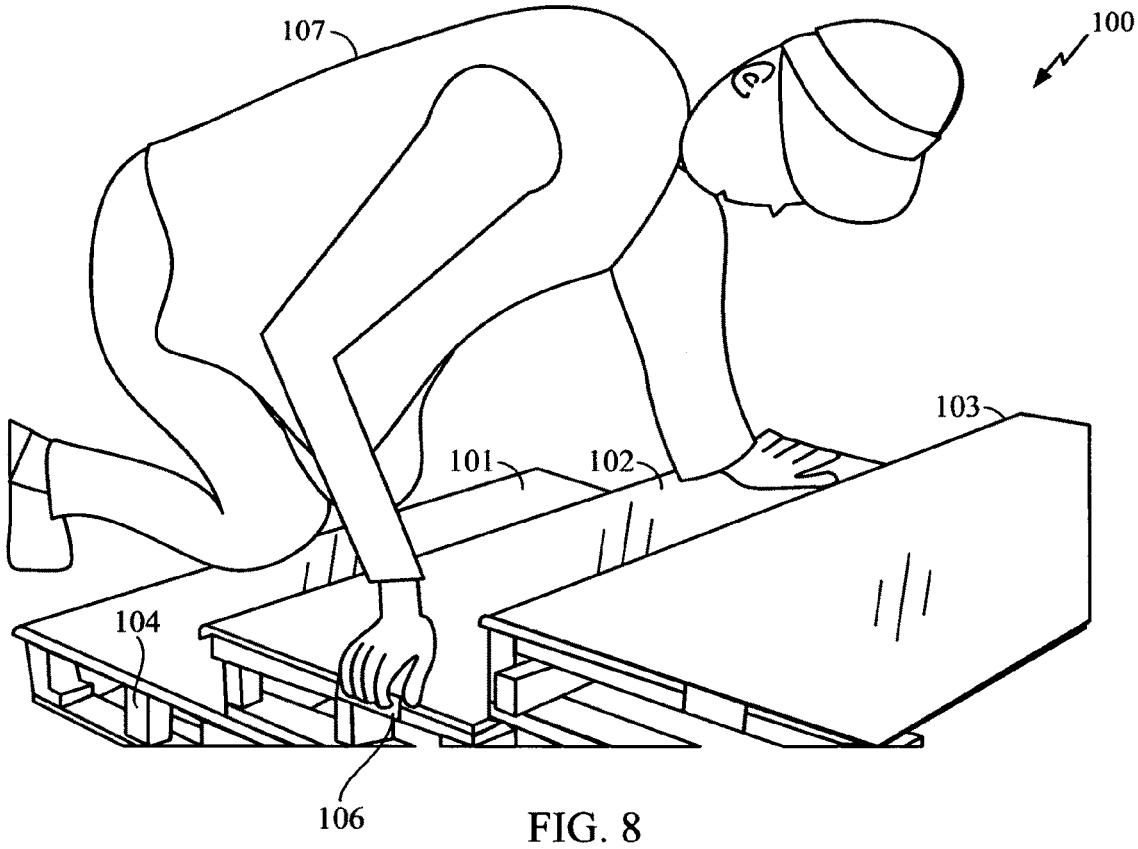
FIG. 8 is an illustration of a manner or method of use of an exemplary UFFD 100.

FIG. 8 is a side view of another manner/method of use for an example UFFD. As shown in FIG. 8, UFFD 100 comprises a first level 101, a second level 102, a third level 103, and a chair 105. Also shown in FIG. 8 is user 107. User 107 has frontally mounted the UFFD 100 using both of her arms at the second level 102 to allow her knees to be moved from the floor surface to the first level 101. This method of use may be utilized both for teaching persons how to get up from the floor, and also to retrain the neural pathways for particular patterns of movement. When using the UFFD 100 as a therapeutic device (such as in a rehabilitation clinic) a patient/user would strengthen their upper and lower extremities by weight bearing and stabilization. A patient would develop trunk control and stability by training in the quadruped position (such as on all four extremities, as shown in FIG. 8). Through repetition, a patient/user develops motor control, strength, joint stability, and the confidence to get up from the floor level with less assistance from a caregiver than without using the UFFD 100. The UFFD concept was conceived due to repeated concerns expressed by patients, over 18 years of clinical practice, with no device to accomplish assisting people up from the floor, even after searching rehabilitation catalogs, the Internet, and other sources.

Figure 9:
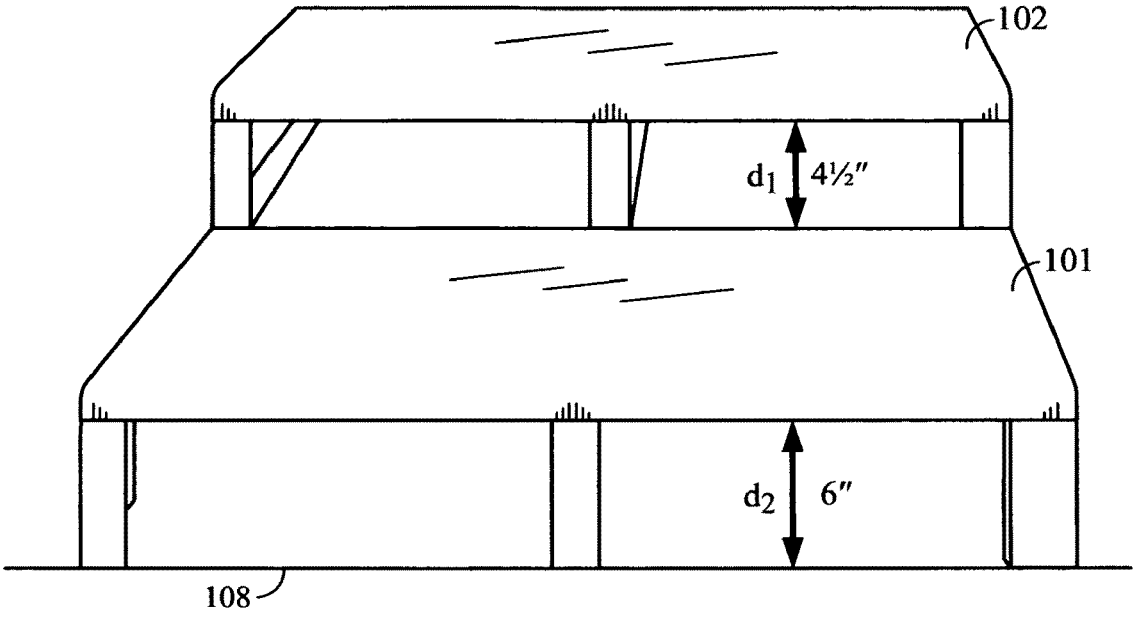
FIG. 9 is an illustration showing a potential distance between a first level and a second level of an exemplary UFFD 100, and a potential distance between a floor surface and a first level of an exemplary UFFD 100.

FIG. 9 illustrates an embodiment of a UFFD 100 where the vertical distance, $d_1$, from the first level 101 to the second level 102 is substantially 4.5 inches. Also shown is the vertical distance, $d_2$, from the floor surface 108 to the first level 101, being substantially 6 inches. As noted herein, exact vertical distances are not overly important, so long as individual vertical distances are substantially 4 to 6 inches, and are less than the vertical distance of a typical staircase step of substantially 8 inches or more. The inventor has discovered that 8 inches or more makes moving between different levels extremely difficult and/or uncomfortable for most semi-ambulatory individuals. The inventor possesses greater than 18 years of clinical experience, and has found that the standard height of steps or stools (typically being 8 inches) is simply too difficult for individuals to negotiate by themselves. Trial and error resulted in the finding that substantially 4.5 inch increments was the preferred distance between levels 101, 102, and 103, as well as between the floor and level 101. Note that the UFFD 100 is not intended to be ambulated upon (that is, to bear the initial weight of a person through the plantar surface of a foot).

Figure 10:
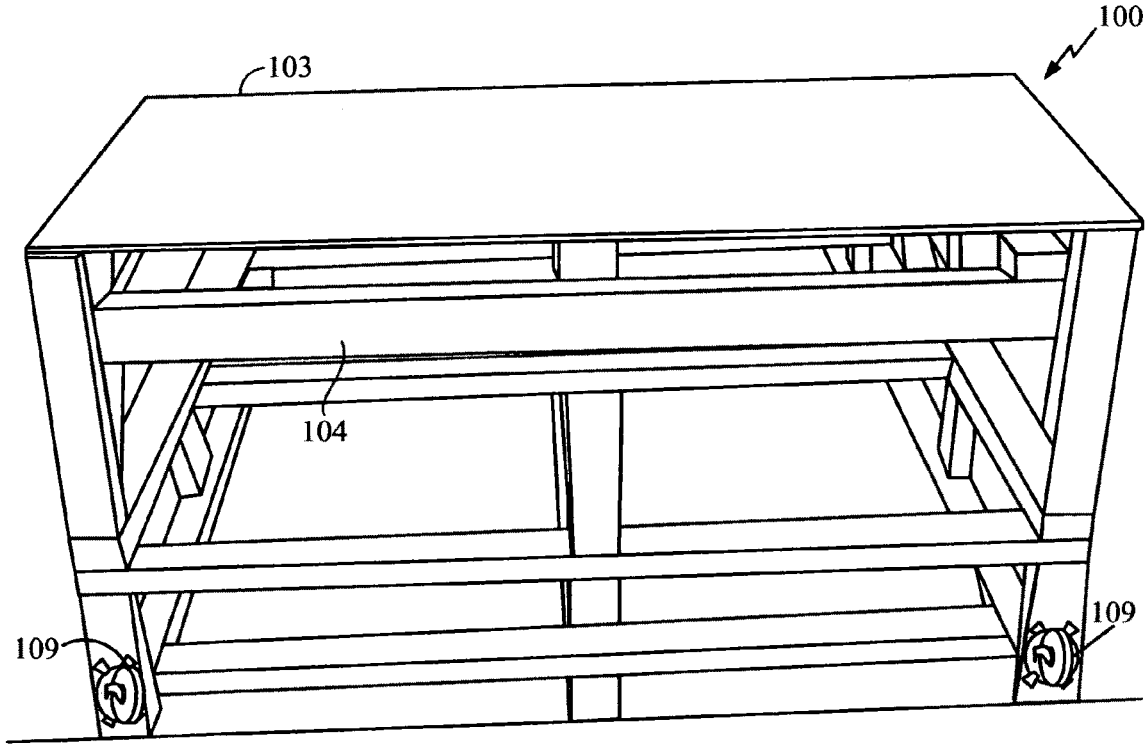
FIG. 10 is an illustration a rear view of an exemplary UFFD 100.
Figure 11:
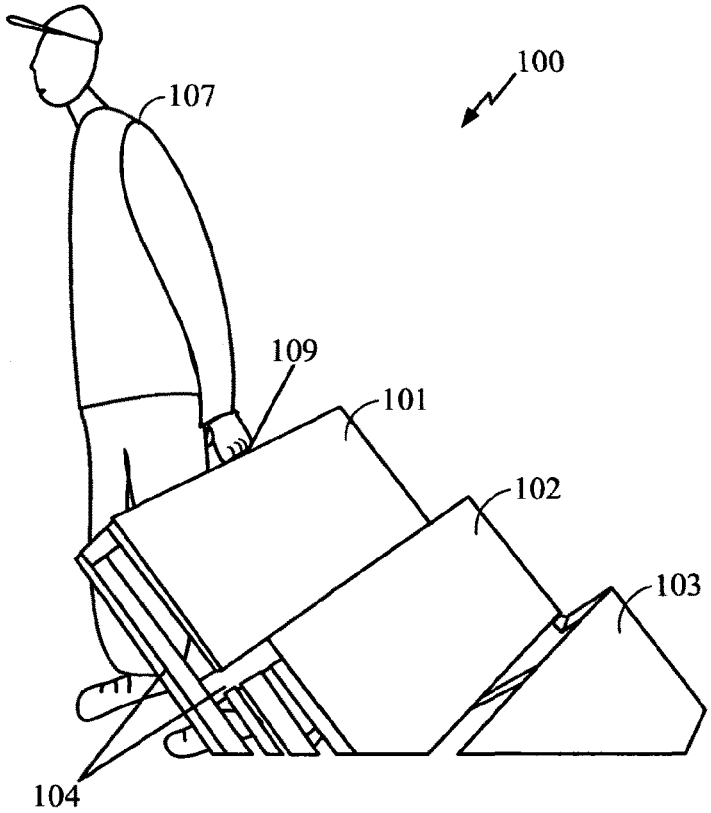
FIG. 11 is a side view of an exemplary UFFD 100 being transported by a user.

FIG. 10 is a rear view illustration of an exemplary UFFD 100. As shown in the Figure, UFFD 100 comprises multiple levels (although only level 103 is showing due to the angle of the illustration). UFFD 100 also comprises support structure 104, and wheels 109. As shown in conjunction with FIG. 11, the wheels 109 permit a user 107 to pull UFFD 100 with ease by lifting the UFFD 100 using a handle 106 so that the wheels engage a floor surface 108. FIG. 11 also depicts UFFD 100 as comprising levels 101, 102, and 103, as well as support structure 104. In certain embodiments, the wheels 109 may be configured to retract based upon a certain weight (e.g., 25 pounds) so that the UFFD remains stationary when being used.

Figure 12:
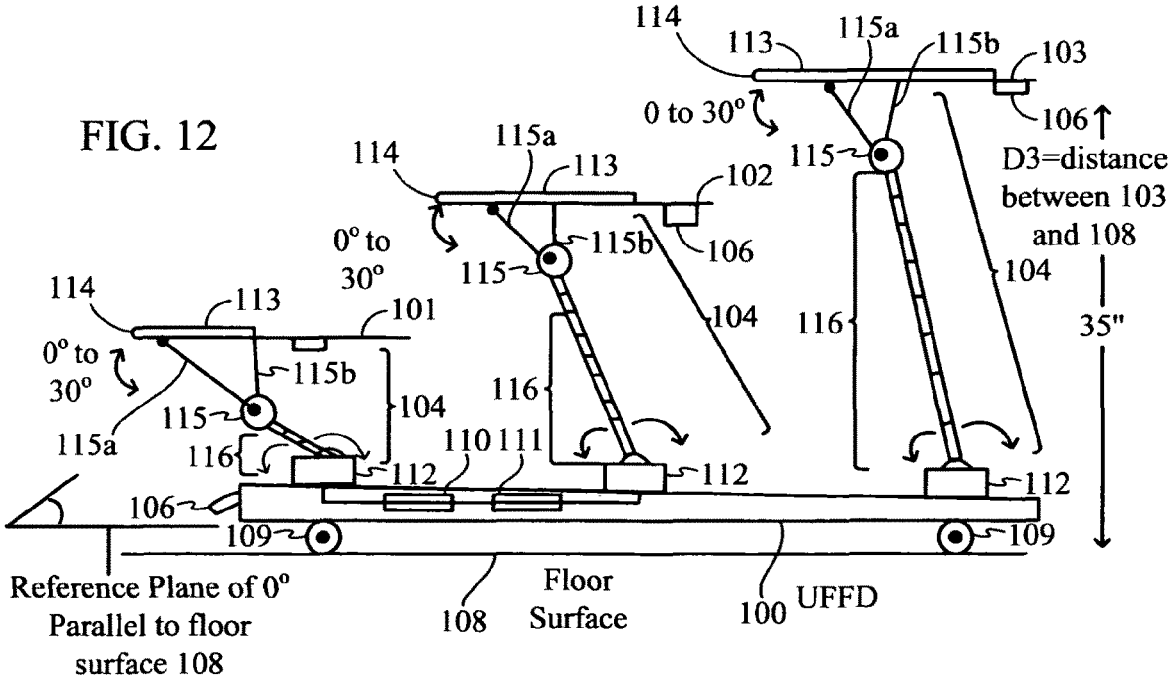
FIG. 12 is a side view of an exemplary UFFD 100 with levels configured to tilt to within 30 degrees of a reference plane that is parallel to a floor surface.

FIG. 12 is an illustration depicting an exemplary UFFD 100. A shown in FIG. 12, the UFFD 100 comprises a first level 101, a second level 102, and a third level 103. Each of levels 101 through 103 are attached to the UFFD through support structure 104. Support structure 104, in the example shown in FIG. 12, comprises a hydraulic telescoping support arm 116 that is configured to extend and contract in length via control signals from controller and memory 110 and 111. While shown as hydraulic telescoping support arms 116, support structure 104 may include other implementations, such as electronic motors that extend and contract support arms, or through other implementation as one of skill in the art would understand.

Actuators 112 actuate and manipulate both the hydraulic telescoping support arm 116 and rotating tilt devices 115. Rotating tilt devices 115 (three are shown in FIG. 12) are attached to structure support arms 115*b* that hold levels 101, 102, and 103 in position. Rotating tilt devices 115 rotate in such a manner as to make rotation arms 115*a* repetitively push and pull a respective level, so that the level is configured to tilt to within a range of 0 degrees to thirty degrees difference in relation to a reference plan that is parallel to the floor surface 108. Both of structure support arms 115*b* and rotation arms 115*a* are hinged connectors at rotating tilt devices 115 and at each of the levels 101, 102, and 103, to provide the ability for the levels to tilt upon command from controller 110 as implemented by actuators 112.

Actuators 112 are also configured to rotate each of the support structures 104 based on a control signal from controller 110, so that one or more of levels 101, 102, and/or 103 experience horizontal movement. In this fashion, each of levels 101, 102, and/or 103 may be manipulated for both vertical and horizontal displacement based upon a particular implementation of the UFFD 100.

FIG. 12 also depicts handles 106 attached to each of levels 101, 102, and 103, and to the front of the UFFD itself. Handles 106 may be pivotally, flush, and/or telescopically mounted to the UFFD 100. Also shown in FIG. 12 are rounded leading edges 114 and pressure relief pads 113 for each of levels 101, 102, and 103, for a user's comfort and ease of use. Pressure relief pads 113 may be gel pads or rubber pads, or any suitable similar material.

Figure 13:
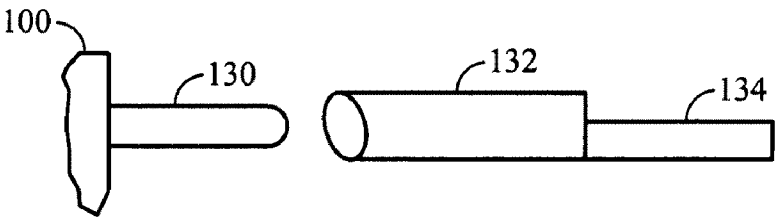
FIG. 13 is a side view of a male and female connection for connecting a chair to an exemplary UFFD 100.
Figure 15:
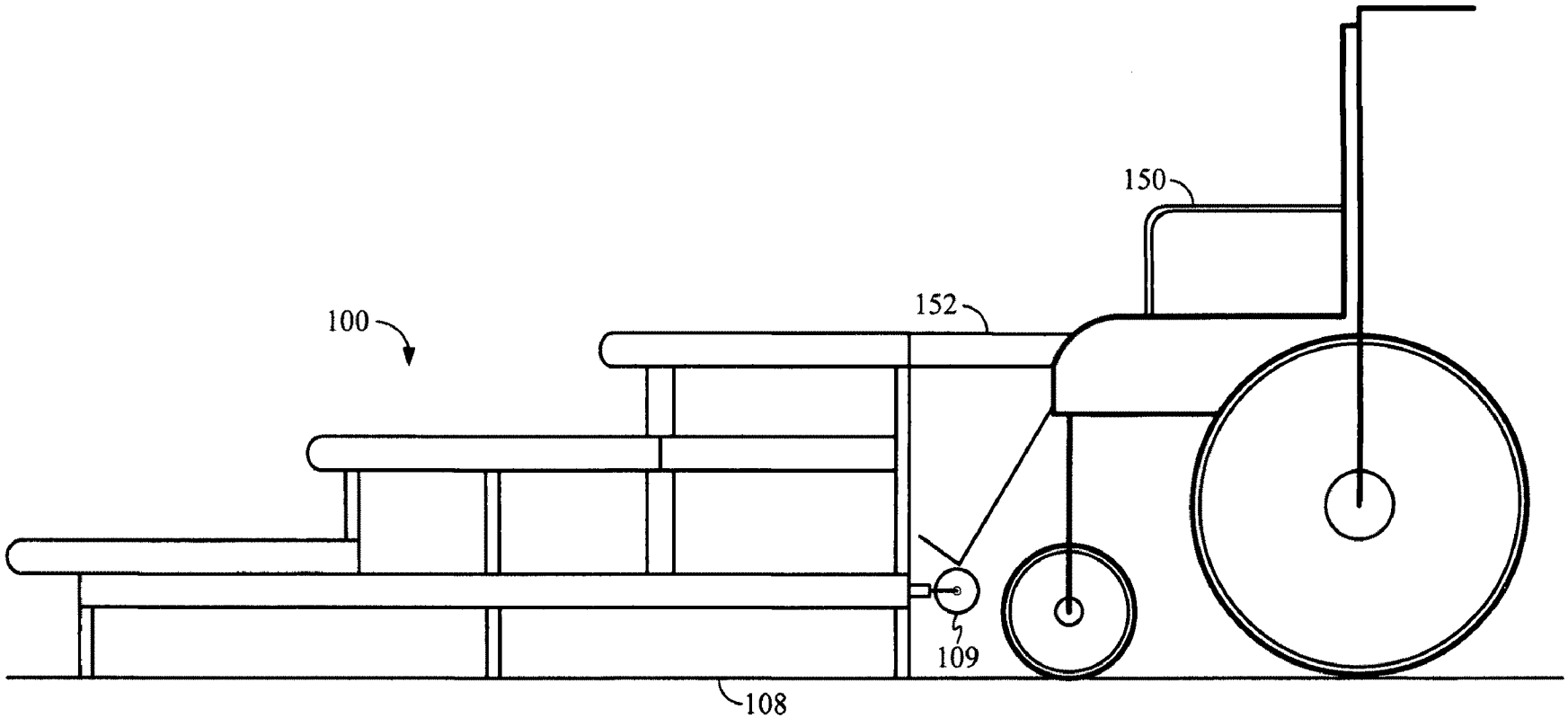
FIG. 15 is side view of an exemplary UFFD 100 attached to a wheelchair.

FIG. 13 is a zoom view of an exemplary connection between UFFD 100 and a chair (for instance, chair 105 shown in FIG. 1 or wheelchair 150 shown in FIG. 15). As shown in FIG. 13, the UFFD 100 comprises male member 130, while a respective chair includes female member 132 connected to structural support member 134. Structural support member 134 is attached to a main weight and/or stress bearing portion of a chair or wheelchair. Male member 130 acts as a guide for female member 132, so that as the two are brought together, they mate and allow the chair to be positioned properly against the UFFD 100. Once properly positioned, the male member 130 may be held in place with a pin (not shown) or a threaded device such as a set screw or with other implementation.

Figure 14:
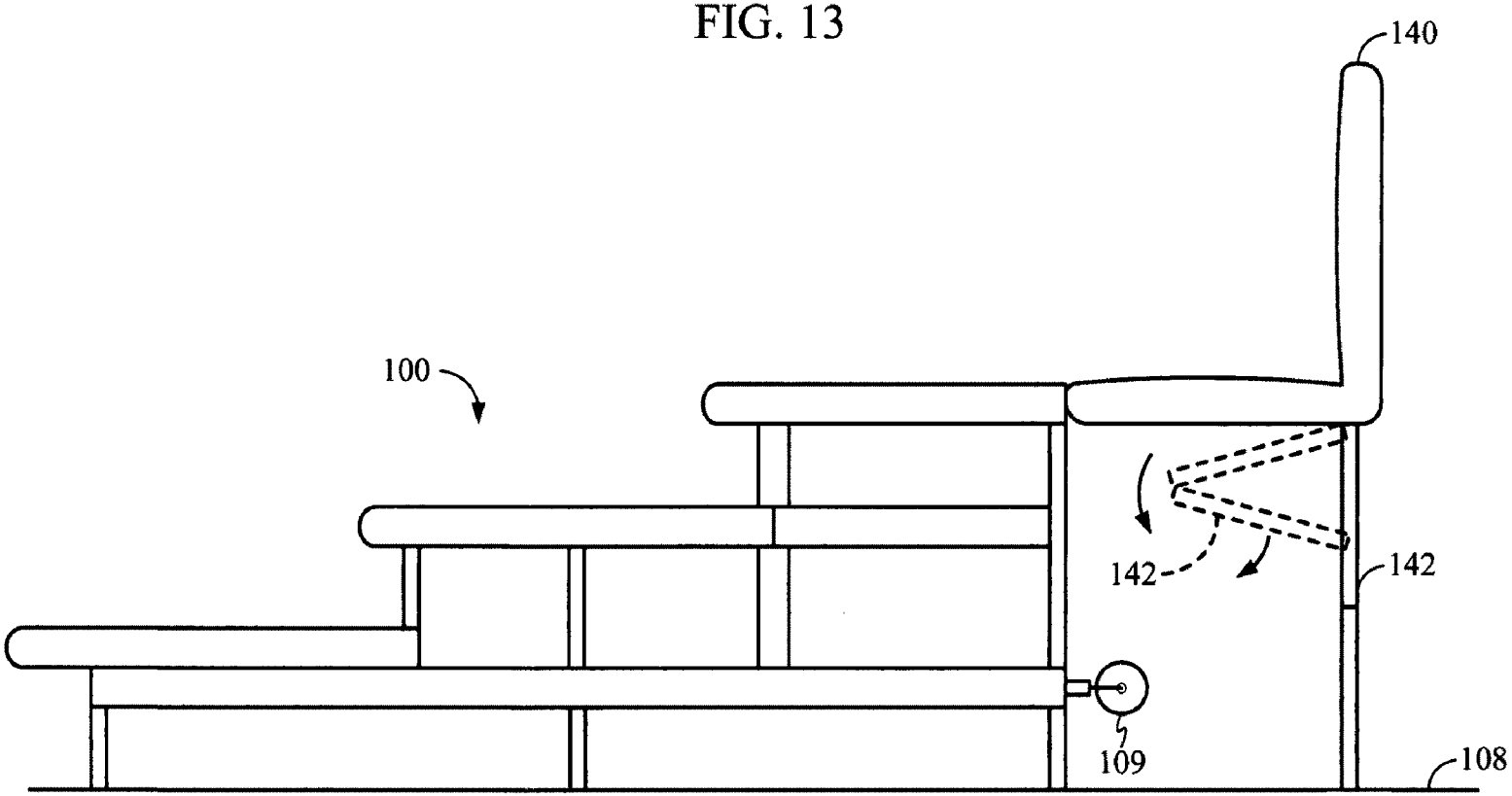
FIG. 14 is a side view of an exemplary UFFD 100 with a folding leg chair.

FIG. 14 is a side view of an exemplary UFFD 100 including a chair 140, with a folding leg 142. As shown in FIG. 14, chair 140 attaches to the UFFD 100, such as through the male and female connection described in FIG. 13. For example, the seat of chair 140 connects to the up-most level of the UFFD 100 using a male and female connector, or other attachment means. Leg 142 is configured to fold potentially frontwards, backwards, or sideways, and into a plurality of segments. When chair 140 is intended to be used by a user, leg 142 is folded down to support the user's weight. When the UFFD 100 is intended to be repositioned or moved around, folding leg 142 is folded up, thereby allowing a user to lift up on the front of the UFFD 100, thereby engaging wheel 109 (such as is shown in FIG. 11) and allowing the UFFD 100 to be repositioned or moved with ease. Chair 140 may also be hinged in its attachment to UFFD 100, such that the chair is configured to hinge in a folding position (with the backrest of the chair hinging/folding to the seat, and the seat hinging to rest upon the top of level 103. In such an exemplary embodiment, chair 140 is also therefore configured to hinge into an unfolded position such as is shown in FIG. 14.

FIG. 15 is a side view of an exemplary UFFD 100, including a wheelchair 150, and a connection piece 152. As shown in FIG. 15, connection piece 152 connects wheelchair 150 to the UFFD 100. Connection piece 152 may attach wheelchair 150 to the UFFD 100 using the male and female connection described above in relation to FIGS. 13 and 14, or may use other connection means such as a ball at the end of a rod that fits into a ball-receiving socket at the front of wheelchair 150, much like a trailer hitch or similar connection device. Other connection devices may be implemented, such as the connection attachment 120 shown in FIG. 1.

The inventor, as a registered Physical Therapist, has found that there are very significant differences between the UFFD and regular steps, or other devices. The inventor's vast experience and past work in Healthcare, Body Mechanic training, Ergonomics training, as well as through learned experience, and education, support the fact that the UFFD is significantly different from regular steps, or other devices.

In regards to Ergonomics, Work Related Repetitive Stress Disorders, and Body Mechanics the inventor cites "Public Health & Preventive Medicine-15th Edition (2008):

"Musculoskeletal disorders are a leading cause of worker impairment, lost work, and compensation." As a physical therapist it is the inventor's professional assessment that any nurse, nursing assistant, therapist, or caregiver using the UFFD would be much less likely to injure themselves assisting a patient with a 4.5 inch lift than the greater heights found with regular steps or other devices.

Actual users of other devices or regular steps give cause for alarm, from the inventor's professional perspective. Individuals may have to grasp handles behind themselves with other devices or with regular steps, thereby placing their shoulders in an "end range" joint position. Placing a joint such as the shoulder in an end range position places the muscles in a mechanically disadvantaged position, thereby predisposing an individual to potential Rotator cuff strain or Rotator cuff tear. Wrist use on other devices is also problematic, in that wrists are placed in an extreme extension position, unnecessarily stressing another part of the user's body.

Figure 16:
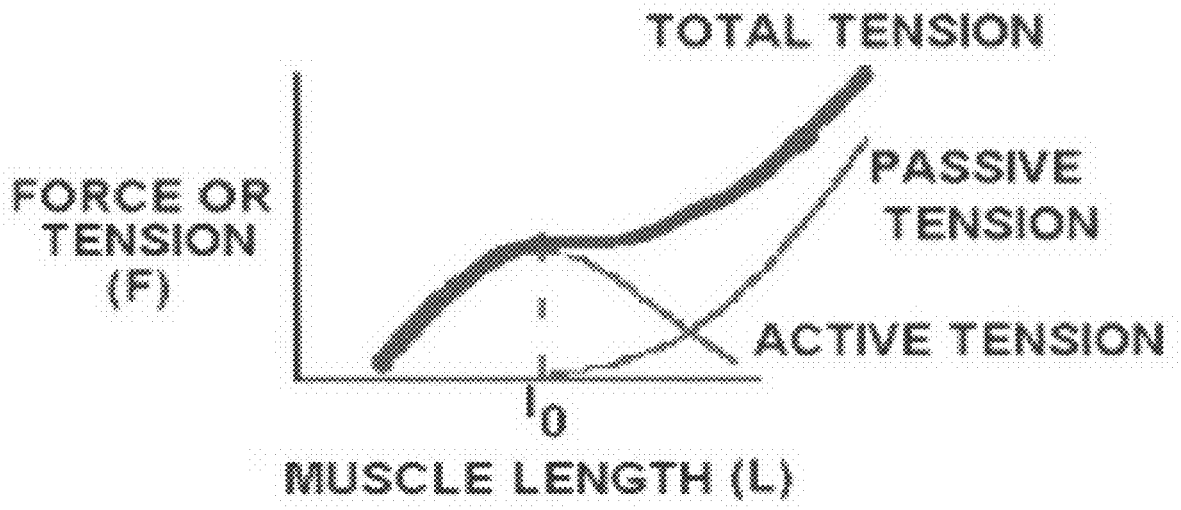
FIG. 16 is a graph showing the length-tension properties of muscle.

FIG. 16 is a graph showing the length-tension properties of muscle, as a force/tension curve. As shown by the curve in FIG. 16, a muscle derives its force comes from two sources: (1) Active tension derived from the interaction between myosin and actin active tension; and (2) Passive tension that can develop in the muscle's complex connective tissue. Length-tension curves appear in other forms, including force-angle curves and stress-strain curves. All the curves share the same characteristic shape, because the variables graphed on the x and y axes are just scaled versions of length and force. Stress-strain curves: Stress, a measure of force per area, replaces force on the y-axis. Strain, an expression of the percentage of elongation beyond resting length, replaces absolute length on the x-axis. Force-angle curves: Joint angle replaces length as the x-axis variable. To use a flexor muscle group as an example, flexors are short when the joint is flexed and elongated when the joint is extended. Moment-angle curves: As long as a muscle's moment arm is relatively constant throughout the range of motion of the joint that the muscle crosses, then the muscle's moment-angle curve has a shape that is similar to that of its force-angle curve.

By observing this length-tension curve one can see that a muscle is strongest in its mid range and weakest when positioned in very short or terminal end range. The UFFD 100's intentionally designed features allow individuals to work in a mid range where they are the strongest and less likely to injure themselves. Using other devices or regular stairs, persons can be observed struggling to reach handles/steps high behind them, or even attempting to use their elbows to propel themselves up. In contrast, the UFFD 100 has intentional design features that allow the use of an elbow in a comfortable mid-range of joint motion.

It is imperative that an assist device minimize strain to any joint or tissue. As cited in *Public Health & Preventive Med* (15th ed. 2008), "[a]s long as demands are kept within reasonable limits, performance will be satisfactory and health will be maintained. However "if stresses are excess, undesirable outcomes may occur in the form of errors, accidents, and/or a decrement in health." The same text states that the therapist's professional discipline concerns evaluating stresses that occur in the work environment and the ability of people to cope with these stresses. It is the "goal is to design facilities (e.g. factories and offices, furniture, equipment, tools, and job demands) to be compatible with human dimensions, capabilities, and expectations."

It is the inventor's sincerest attempt to deliver a safe and effective method for patients or individuals to raise themselves up from the floor that requires another design concern with other devices that the UFFD 100 resolves. *Chronic Wound Care A Clinical Source for HeatlthCare Professionals* (Edited by Diane Krasner RN, MS, CETN) is considered a gold standard in caring for wounds and overall skin care.

Other devices are typically metal devices with relatively sharp corners and edges that will result in significant "shear" forces to the skin as one negotiates over each leading edge of each step. *Chronic Wound Care A Clinical Source for Heatlth-Care Professionals* states that "shear is caused by tissue layers sliding against each other (e.g. when patient slides down in bed). This results in disruption or angulation of blood vessels." This textbook for healthcare professionals emphasizes the importance in reducing or relieving shear forces that the topic of is cited in the index 16 times in the 478 page textbook. This text describes that "a transfer device should consider shear forces in design in which a patient move upon or along (P.85)" and that "a Physical therapist can determine the type and frequency of movement for each individual." The UFFD 100 design intentionally includes features that prevent shear forces by having rounded leading edges to minimize tissue stress on the Ischial tuberosities, sacrum, and buttocks that are often common structures subjected to shear stresses.

It is the inventor's hope that any examiner or reviewer who may be involved in the consideration process of the UFFD patent application has a thorough understanding of the UFFD 100's design in comparison to what is currently on the market (such as regular stairs, or devices such as the paraladder found at www.paraladder.com).

Controller 110, as described herein, may include one or more of a general-purpose processor or specific-purpose processors for executing instructions and may further include a machine-readable medium (e.g., volatile or non-volatile memory) for storing data and instructions for software programs. The term "processor" may refer to one or more processing devices, one or more processors, and/or one or more components thereof. For example, a processor may refer, without limitation, to an aspect of controller 110, actuators 112, and/or rotating tilt devices 115. A processor may be an integrated circuit or a computer system.

The control aspects of controller 110, actuators 112, and/or rotating tilt devices 115 may be implemented using software, hardware, or a combination of both. By way of example, any processor discussed herein may be a general-purpose microprocessor, a microcontroller, a Digital Signal Processor (DSP), an Application Specific Integrated Circuit (ASIC), a Field Programmable Gate Array (FPGA), a Programmable Logic Device (PLD), a controller, a state machine, gated logic, discrete hardware components, or any other suitable entity that can perform calculations or other manipulations of information. Software, instructions, and operations, as discussed herein, shall be construed broadly to mean instructions, data, or any combination thereof, whether referred to as software, firmware, middleware, microcode, hardware description language, or otherwise. Instructions may include code (e.g., in source code format, binary code format, executable code format, or any other suitable format of code).

One of ordinary skill in the art would understand that a machine-readable medium may include any machine-readable media and storage integrated into a processor, such as may be the case with an ASIC. A machine-readable medium may also include any machine-readable media and storage external to a processor, such as a Random Access Memory (RAM), a flash memory, a Read Only Memory (ROM), a Programmable Read-Only Memory (PROM), an Erasable PROM (EPROM), registers, a hard disk, a removable disk, a CD-ROM, a DVD, or any other suitable storage device. A machine-readable medium may include one or more media. According to one aspect of the disclosure, a machine-readable medium is a computer-readable medium encoded or stored with instructions and is a computing element, which defines structural and functional interrelationships between the instructions and the rest of the system, which permit the instructions' functionality to be realized. Instructions may be executable, for example, by a processor. Instructions can be, for example, a computer program including code.

The description of the subject technology is provided to enable any person skilled in the art to practice the various configurations described herein. While the disclosure has been particularly described with reference to the various figures and configurations, it should be understood that these are for illustration purposes only and should not be taken as limiting the scope of the subject technology.

There may be many other ways to implement the subject technology. Various functions and elements described herein may be partitioned differently from those shown without departing from the spirit and scope of the subject technology. Various modifications to these configurations will be readily apparent to those skilled in the art, and generic principles defined herein may be applied to other configurations. Thus, many changes and modifications may be made to the subject technology, by one having ordinary skill in the art, without departing from the spirit and scope of the subject technology.

It is understood that the specific order or hierarchy of steps or blocks in the processes disclosed is an illustration of exemplary approaches. Based upon design preferences, it is understood that the specific order or hierarchy of steps or blocks in the processes may be rearranged. The accompanying method claims present elements of the various steps in a sample order, and are not meant to be limited to the specific order or hierarchy presented.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for."

All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

What is claimed is:

1. An up-from-floor device (UFFD), comprising:

a first level substantially parallel to a floor surface, the first level being substantially 26 to 30 inches in length and substantially 10 to 12 inches in width, and configured to be elevated from the floor surface by substantially 4 to 5 inches;

a second level substantially parallel to the floor surface, the second level being substantially 26 to 30 inches in length and substantially 10 to 12 inches in width, and configured to be elevated from the floor surface by substantially 9 to 10 inches;

a third level substantially parallel to the floor surface, the third level being substantially 26 to 30 inches in length and substantially 10 to 12 inches in width, and configured to be elevated from the floor surface by substantially 13 to 14 inches; and a handhold indented into a side edge of at least one of the first, second, and third levels;

wherein the first, second, and third levels are located substantially adjacent to each other, at different heights, with the second level in-between and substantially abutting both of the first and third levels, and the first, second, and third levels are each configured with a curved leading edge to prevent shear forces from causing discomfort or damage to a user.

2. The UFFD of claim 1, comprising:

a support structure for each of the first, second, and third levels, wherein the support structure is configured to maintain each of the first, second, and third levels at the different heights.

3. The UFFD of claim 1, further comprising a seating surface at substantially the height of the third level or higher.

4. The UFFD of claim 1, wherein:

the handhold is configured for at least one of maneuvering the UFFD and for assisting a user in pulling or otherwise placing themselves on the first, second, and/or third levels.

5. The UFFD of claim 2, wherein:

the support structure comprises at least one of a carbon composite, foam, metal, wood, plastic, and fiberglass.

6. The UFFD of claim 2, wherein:

the support structure is configured for at least one of vertical and/or horizontal movement, wherein vertical movement configures a height for each of the first, second, and third levels of between 0 and 35 inches in relation to the floor surface, and horizontal movement configures the first, second, and third levels as between substantially adjacent to one another to being stacked, one atop the other, with the second level between the first and third levels.

7. The UFFD of claim 6, comprising:

a controller comprising a processing unit and a memory, wherein, the support structure is electronically controlled by the controller for the at least one of the vertical and/or horizontal movement.

8. The UFFD of claim 7, wherein:

the controller is configured to control an angle of the first, second, and/or third levels to within a thirty degree deviation from a reference plane created by the floor surface.

9. The UFFD of claim 3, comprising:

a leg attached to the seating surface for supporting the weight of a user when seated and configured to fold into segments to allow a user to cart the UFFD with a wheel attached to the UFFD.

10. The UFFD of claim 1, comprising:

a handle that is at least one of pivotally, flush front, and/or telescopically mounted to the UFFD.

11. The UFFD of claim 2, wherein: the support structure connects all of the first, second, and third levels together.

12. The UFFD of claim 11, comprising:

a chair with a seat substantially 15 inches or more from the floor surface configured to connect either permanently or temporarily to the support structure so that the seat is substantially adjacent to the third level.

13. The UFFD of claim 1, comprising:

wheels, wherein the wheels are configured to provide movement of the UFFD from location to location.

14. The UFFD of claim 1, comprising:

padded pressure relief pads on at least one of the first, second, and third levels, wherein the padded pressure relief pads are configured to provide relief to a user's extremities during use.

15. The UFFD of claim 2, wherein:

the support structure is configured to support up to 400 lbs.

16. The UFFD of claim 1, wherein:

at least one of the first, second, and/or third levels comprises a non-slip surface.

17. A method of use of an up-from-floor-device (UFFD), comprising:

pulling a handhold that is indented into a side edge of a first level located substantially 4 to 5 inches above a floor surface, the first level being substantially parallel to the floor surface and being substantially 26 to 30 inches in length and 10 to 12 inches in width;

continuing the pulling on the handhold until a user has located their person upon the first level;

pulling a handhold that is indented into a side edge of a second level located substantially 9 to 10 inches above the floor surface, the second level being substantially parallel to the floor surface and being substantially 26 to 30 inches in length and 10 to 12 inches in width;

continuing the pulling on the handhold until a user has located their person upon the second level;

pulling a handhold that is indented into a side edge of a third level located substantially 13 to 14 inches above the floor surface, the third level being substantially parallel to the floor surface and being substantially 26 to 30 inches in length and 10 to 12 inches in width; and continuing the pulling on the handhold until a user has located their person upon the third level; wherein each of the first, second, and third levels are configured with a curved leading edge to prevent shear forces from causing discomfort and damage to the user.

18. The method of claim 17, further comprising:

pulling a grip or handle on a chair adjacent to the third level and located at least 15 inches above the floor surface until a user has located their person upon the chair.

19. The method of claim 17, further comprising:

controlling a height of at least one of the first, second, and/or third levels with a controller comprising a processor and a memory.

20. The method of claim 17, further comprising:

controlling an angle, in relation to a reference plane created by the floor surface, of at least one of the first, second, and/or third levels, to within thirty degrees or less of the reference plane.

* * * * *